US006796390B1

(12) United States Patent
Bakker

(10) Patent No.: US 6,796,390 B1
(45) Date of Patent: Sep. 28, 2004

(54) METHOD AND DEVICE FOR MOVING A TUBE IN A BOREHOLE IN THE GROUND

(75) Inventor: Thomas W. Bakker, Vries (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/088,930

(22) PCT Filed: Sep. 21, 1999

(86) PCT No.: PCT/NL99/00586

§ 371 (c)(1),
(2), (4) Date: Jul. 18, 2002

(87) PCT Pub. No.: WO01/21929

PCT Pub. Date: Mar. 29, 2001

(51) Int. Cl.[7] ..... E21B 3/025; E21B 7/24

(52) U.S. Cl. ..... 175/61; 175/195; 175/171; 175/214; 175/107

(58) Field of Search ..... 175/171, 195, 175/61, 73, 162, 214, 215, 92–107; 173/148, 144, 145

(56) References Cited

U.S. PATENT DOCUMENTS

| | | | | | |
|---|---|---|---|---|---|
| 2,784,942 | A | * | 3/1957 | Peck et al. | 175/171 |
| 3,815,691 | A | | 6/1974 | Richter | |
| 3,901,331 | A | * | 8/1975 | Djurovic | 175/171 |
| 4,088,865 | A | | 5/1978 | Peters et al. | |
| 4,133,396 | A | * | 1/1979 | Tschirky | 175/57 |
| RE33,793 | E | * | 1/1992 | Cherrington et al. | 175/61 |
| 5,101,913 | A | * | 4/1992 | Stockley et al. | 175/65 |
| 5,271,472 | A | * | 12/1993 | Leturno | 175/107 |
| 5,472,057 | A | * | 12/1995 | Winfree | 175/57 |
| 5,778,992 | A | * | 7/1998 | Fuller | 175/73 |
| 6,119,772 | A | * | 9/2000 | Pruet | 166/81.1 |
| 6,368,021 | B1 | * | 4/2002 | Strong et al. | 405/228 |
| 6,378,626 | B1 | * | 4/2002 | Wallace | 175/19 |

FOREIGN PATENT DOCUMENTS

| | | |
|---|---|---|
| DE | 1171848 | 6/1960 |
| DE | 1814728 | 7/1970 |
| EP | 0 058 222 | 8/1982 |
| EP | 0 727 560 | 8/1996 |
| FR | 2393114 | 12/1978 |
| GB | 521018 | 11/1938 |
| GB | 591922 | 5/1945 |
| GB | 596715 | 7/1945 |
| JP | 08028172 | 1/1996 |
| JP | 10196261 | 7/1998 |
| SU | 800337 | 1/1981 |

OTHER PUBLICATIONS

R.A. Ioanesian, *Fundamentals of turbodrilling theory and technology;* Gostopekhizdat Publishing House, Moskow 1953.

V.T. Borisovich et al, *Drilling of large diameter boreholes;* Nedra Publishing House, Moskow 1977, pp. 208–213.

M. Gulizade, *A Method for Controlling an Azimuth Distortion of a Well Bore,* 1989, pp. 44–45.

* cited by examiner

*Primary Examiner*—David Bagnell
*Assistant Examiner*—Shane Bomar
(74) *Attorney, Agent, or Firm*—Kinney & Lange, P.A.

(57) ABSTRACT

A tube (1) in a borehole (2) in the ground (3) is displaced. The tube is simultaneously displaced along and about its axis, such that it is axially introduced into or retracted from the borehole. According to the invention, displacing the composed tube about its axis comprises an oscillating movement. The invention further relates to a device for displacing a tube in a borehole.

71 Claims, 5 Drawing Sheets

METHOD AND DEVICE FOR MOVING A TUBE IN A BOREHOLE IN THE GROUND

FIELD AND BACKGROUND OF THE INVENTION

This invention relates to a method for axially moving a tube in a borehole in the ground according to the introductory portion of claim 1. The invention further relates to a device for axially moving a tube into a borehole in the ground according to the introductory portion of claim 19.

GB 591 922 and GB 596 715 disclose a method for axially moving a tube carrying a drill in a borehole in the ground, wherein the tube is moved simultaneously along and about its axis in a series of alternating, angularly opposite, rotating movements within a limited angular range of rotation of less than 180°.

Methods and devices according to the preamble of claims 1 and 19 are known from practice, for instance for axially inserting a tube in a borehole or for axially retracting tube from a borehole. Such a tube may be used for the drilling process and simultaneously for the protection of the newly drilled wellbore. This technique is commonly referred to in the field as casing drilling. Such a borehole can be used for extracting oil or gas and for other purposes, such as for the extraction of salt or geothermal energy and also for civil engineering purposes such as laying pipelines under rivers.

When using the known methods and devices, usually a first tube part is inserted into a borehole in the ground provided by a drill. Subsequently further tune parts are coupled to the upper end of the tube reaching into the borehole, via a screw and/or clamp coupling. As the tube is introduced further into the ground, successive tube parts, which can each be composed of one or more pre-connected tube joints, are connected to the proximal end of the composed section of tube end projecting from the ground until the tube has reached its final length. When the tube is removed, this method is essentially reversed. the frictional force between the tube and its surroundings with a tangential component, thus reducing the axial frictional component, which substantially decreased the axial force needed to insert or retract the composed tube into or from the borehole. It shall be clear that also a single length of tube can be used instead of connected tube parts.

A disadvantage of the known method and device for axially moving a tube in this manner is that, due to the continuous rotation of the tube, it is a problem to provide solid-state, safe connections between the stationary ground and apparatuses rotating jointly or solidarity with the tube. In particular, during drilling operations a swivel connecting the tube to a mud supply is to be provided with an elaborate rotational seal. The same holds true for e.g. hydraulic connections to a drill carried on the tube or pneumatic connections to a packer connected to the tube. In particular, providing a spark-free electrical connection between devices rotating substantially jointly with the tube and the ground in the often explosion endangered environment near a borehole has proven to be a problem.

In practice, due to the problem of providing a reliable connection, often the rotation is stopped, when e.g. a drill needs to be retracted or when an inspection apparatus has to be lowered. This greatly increases the risk of the tube getting stuck due to the settling of the ground or due to a phenomenon known in the field as differential sticking.

In the currently known art of casing drilling, the direction of the tube is controlled by devices protruding from the lower end of the tube. The application of such devices is costly and the measure of control is limited. As such it is currently not feasible to apply casing drilling for high angle or near horizontal holes.

SUMMARY OF THE INVENTION

It in an object of the invention to circumvent, at least to a considerable extent, the drawbacks associated with the above method and device.

This object is achieved according to the present invention by carrying out a method for axially moving a tube in a borehole in the lithosphere in accordance with claim 1. The invention further provides a device according to claim 19 which is specifically adapted for carrying out such a method.

By twisting the tube about its axis in a series of alternating, angularly opposite, rotating movements within a limited angular range of rotation, it is possible to use relatively simple, flexible connections extending between fixed couplings to provide a connection between devices rotating jointly or solidarily with the composed tube and the stationary ground. An example of such a flexible connection extending between fixed couplings is e.g. a length of flexible hose or pipe fixed with simple clamps on each end for fluid connections or a length of insulated cable provided with plugs on each end for co-operation with sockets to provide an electrical connection.

The limited rotational angle of this "oscillating" rotational movement will prevent the flexible connections from becoming wound-up too far as would be the case with an increasing rotational angle caused by the rotational movement of the prior art.

Furthermore, during insertion or retraction of a device, e.g. a drill, a packer, a sensor or an inspection apparatus, through the inside of the tube, the tube can be oscillated continuously, thus greatly reducing the risk of the tube getting stuck.

The angular range of rotation can be preselected to comprise approximately one full rotation of 360, e.g ranging from −180° to +180, or 0° to 360°. The range can also comprise more than one full rotation, i.e. include an angle of more than 360° in e.g. the interval from 0° to 720° or −360° to +360° or a multiple of this angle or less than one full rotation, e.g. 0° to 180° or −90° to +90°. Preferably, less than 5 full rotations in one direction, e.g. left hand rotations, are followed by the same number of full rotations in the opposite direction, e.g. right hand rotations.

The oscillating movement can be such that each alternating angular movement is substantially equal in magnitude, such as to achieve a symmetric pattern. However, it is also possible to perform a series of alternating rotating movements that are not equal in magnitude, e.g. a series of alternating movements that provide a gradual angular drift which may have an oscillating pattern so that the total angle of rotation remains within a limited angular range at all times or be a drift in one sense so that the total angle of rotation remains within a limited angular range for a limited duration only. Such a duration may for instance be of sufficient length to perform operation on or with the tube, such as steering the drilling direction or connecting an end of tube material to the tube.

It shall be clear that within this context the rotational angle within the pre-selected angular range is defined as an absolute angle of rotation of the tube about its axis, relative to the ground.

Furthermore, it shall be clear that when axially moving the tube, a first series of alternating angularly opposite rotating movements performed within a first pre-selected angular range of rotation can be followed by a second series of such movements within a second range.

The frequency of the opposite movements or oscillations is preferably less than several oscillations per minute, typically less than 10 oscillations per minute and/or can be chosen to match the natural frequency of the tube in the ground. In the proposed method the oscillations are preferably performed at 0,1 or 0,05 Hz. The method however does not exclude the application of a higher frequency of oscillation, e.g. in a typical range from 1 to 50 HZ.

In another advantageous embodiment of the invention a welding or cutting apparatus oscillates substantially jointly or in unison with a composed tube and a rotating tube part to be connected therewith, respectively to be cut therefrom. This enables continuous insertion or retraction of the tube into/from the borehole, as will be elucidated further. It should be noted that welded or other rotationally rigid connections between the successive tube parts are especially advantageous in view of their increased resistance to become undone by the angularly opposite rotational movements cared to the screw connections generally used to couple successive casing or tubing parts. The rotationally rigid connections between the tube elements allow precise control of the relative orientation of the tube end below the surface and the tube part visible at the surface. The use of an axial line provided on the outside of the tube, e.g. by inscription, and precise measurement of the angle between the line on each consecutive tube section will provide an exact knowledge of the orientation of tube end below the surface.

By measuring the torque exerted on the tube at the surface while performing angularly symmetric oscillations, a mid-point position can be determined, characterised by the mid-point of the lower torque values. The azimuth of this mid-point position relative to the azimuth of the inscribed line is indicative for the azimuth of the tube end. The tube end azimuth determined in this way can be corrected for the reactive torque of the drilling tool suspended in the tube end, if necessary.

Another important advantage of the consecutive angularly opposite movement is that, by performing the consecutive movements within a circle segment, a tube having a bent tip can be steered while inserting it axially into the ground. Instead of a bent tip, it is also possible to use other kinds of devices standing-off asymmetrically from the axis A at the end of the tube tip. In order to change the direction of the borehole to be drilled, i.e. the azimuth and angle of the borehole, the oscillating range is chosen to be symmetrical about a predetermined tube end azimuth and to include less than 360° rotation of the tube end, for instance a range from −45° to +45°. These small oscillations achieve that the cutting process at the tube end preferentially removes rock or ground in a circle segment corresponding to the desired hole direction This process is continued until the desired tube end hole angle in the desired tube end azimuth is achieved. In order to continue the borehole at the same hole angle in the desired tube end azimuth, the oscillations and rotation are adjusted such that the cutting process at the tube end removes equal amounts of rock in all directions. The borehole can thus be steered in the desired direction using surface measurements based on the azimuth of the line and inclination measurements at the tube end. Preferably, a drill is used of which the rate of material removal is independent of the direction or speed of rotation, e.g. a hydraulically-powered chisel.

In addition, by providing a mud chamber fixedly connected to a mud supply by means of two flexible hoses, the supply of mud can be continued while tube parts are added to a tube or are separated therefrom.

Particularly advantageous elaborations of the invention are set forth in the dependent claims. Further objects, elaborations, effects and details of the invention appear from the following description, in which reference is made to the drawing.

DETAILED DESCRIPTION

Although the exemplary elaborations discussed below generally relate to composing and inserting a casing into a borehole in the ground by means of a casing drilling process, wherein the tube to be inserted carries a drill, similar elaborations can also be applied to insertion of other types of (composed) tubes into a borehole in the ground or retracting such tubes from such a borehole, which tubes need not carry a drill.

Figure 1:
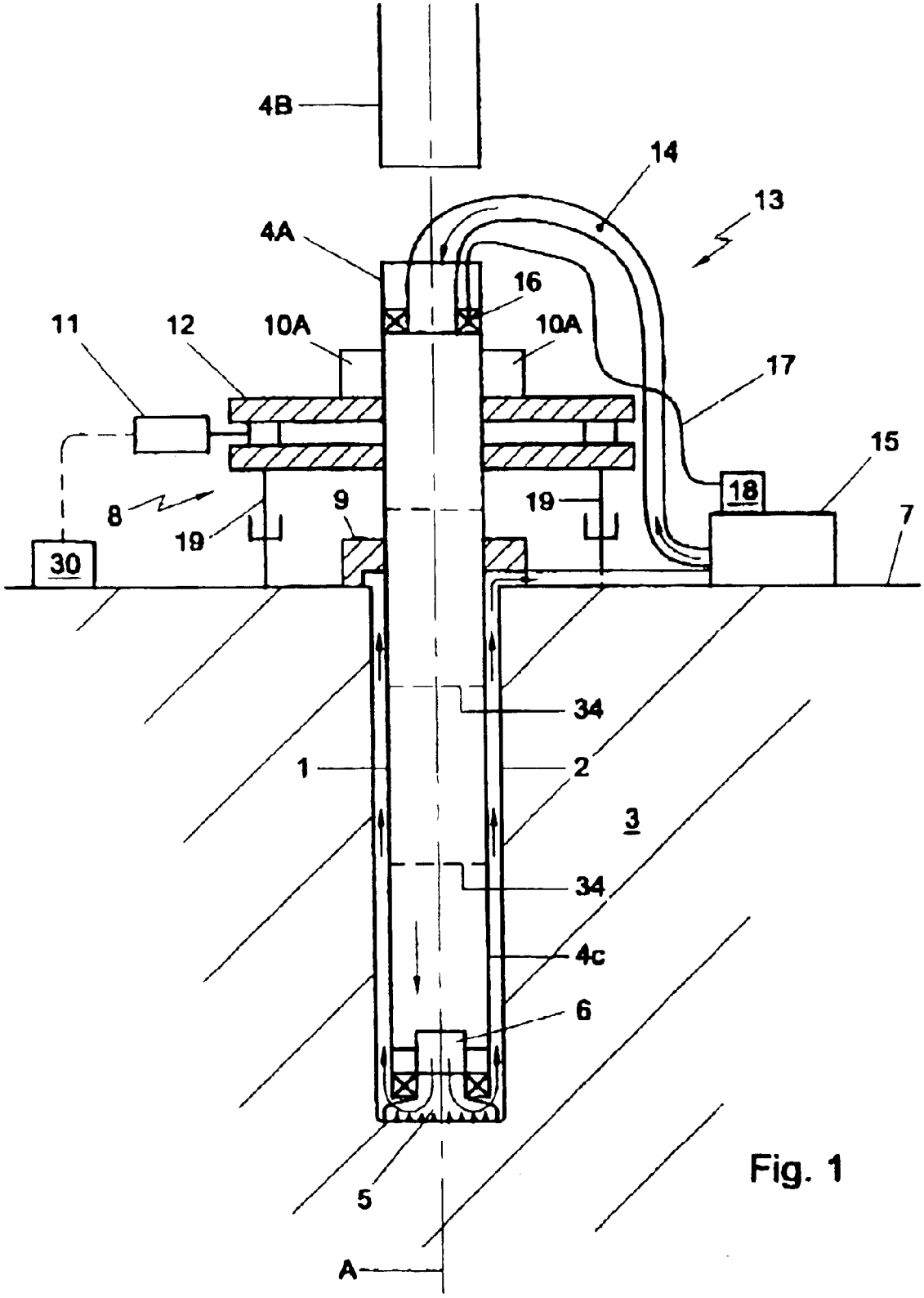
FIG. 1 is a schematical cross-section of a casing 1 being inserted in a borehole.

FIG. 1 shows a tubular casing 1 which is introduced into a borehole 2 in the ground 3. The casing 1 is composed by connecting successive tubular casing parts 4, e.g. 4A and 4B end-to-end. The first or bottom moat casing part 4C carries a collapsable drill 5 having an outer diameter slightly larger than the diameter of the casing parts. The drill 5 is driven by a mud motor 6, which is in turn powered by means of a high-pressure flow of mud induced through the inside of the casing 1. The drill can e.g. comprise a so-called collapsable crushing or gauging drilling bit for removing rock. After passing through the mud motor 6, the mud emerges from the casing 1 at the location of the drill 5 and washes upwards to the surface 7 between the outer diameter of the casing 1 and the walls of the borehole 2. In the drawing, the flow path is shown with arrows.

It shall be noted that instead of a drill 5 comprising a mud motor/bit combination, a mud hammer assembly with a collapsible chisel type bit can be applied, alternatively high pressure jetting assembly can be applied for rock removal. Instead of powering the drill, hammer or jetting assembly with hydraulic energy, electrical or pneumatic drive mechanisms may also be applied.

It shall also be noted that to ensure that the diameter of the hole 2 is sufficiently large for the casing 1, a cutting structure may be applied to the outside of the tube tip, specifically adapted for operating with an oscillating motion of the tube tip.

The casing 1 is axially advanced along its axis A into the borehole 2 by means of a drilling table a mounted above the well head 9, which can include a usual blowout preventor. The well head 9, including the blowout preventor is placed on the surface 7 to seal the area between the casing 1 and the borehole 2.

The drilling table 8 is mounted on leg structures 19 of which the effective length can be changed, e.g. by means of hydraulic cylinders. The drilling table 8 is provided with grippers 10A frictionally engaging the outer circumference of the proximal end of the casing 1 projecting from the borehole 2 beyond the surface 7. These grippers are capable of supporting the full weight of the tube plus the upward friction and transmitting left and right hand torque to the tube to a maximum of the torsional strength limit of the tube. As the drill 5 cuts through the ground 3, the casing 1 is advanced axially along its axis A into the borehole 2 by decreasing the length of the legs 10. To decrease the friction in axial direction between the casing 1 and the borehole 2, the casing is moved about its axis A in a series of alternating, angularly opposite rotating movements within a pre-selected angular range of rotation.

The consecutive, angularly opposite, rotating movement is for instance performed by firstly rotating the casing 1080° clockwise about its axis relative to the ground, followed by a countering rotation of 1080° counter clockwise, followed by a clockwise rotation of 1080° and so on. Thus, an oscillating movement is performed within a pre-selected range of 0°–1080°. It shall be clear that it is also possible to start off with a first rotation of e.g. half or double the angle $\alpha$ of the countering movement. Also, it shall be clear that it may be possible to perform consecutive, angularly opposite rotating movements having angular values $\alpha$ that are not equal in size and still remain within the pre-selected range, at leat during a preselected time interval The oscillating movement is generated by control means 30 controlling a motor 11 which drives a rotationally disposed upper portion 12 of the drilling table B to rotate in consecutive, angularly opposite rotational movements. The upper portion in turn carries the clamps or grippers 10A for transmitting torque between the upper portion 12 and the casing 1. It shall be clear the entire leg structure 19 may be supported such that it oscillates as one unit. The amount of time needed to perform the two consecutive opposite angular movements is e.g. 10 sec., corresponding with a frequency of oscillation of 0,1 Hz.

It is also possible to vary the time of a full oscillation cycle during the course of inserting the tube in order, for instance to adapt the oscillating frequency to changes in the length and natural frequency of the tube or to requirements brought about by operations to be performed with or on the tube, such as connecting a next end of tube material or steering the tip of the tube into a different direction.

As is clear from FIG. 1, the mud supply line 13 comprises a simple, solid-state and safe connection between the surface 7 and the oscillating casing 1. The mud supply 13 comprises a flexible hose 14 that is fixedly connected to the mud pump 15 by means of clamps on one end and that is fixedly connected by clamps to a packer 16 rotating jointly with the casing 1 on the other end. Due to the fact that the absolute angle $\alpha$ of axial rotation of the casing remains within the pre-selected range, the flexible hose 14 between the mud pump and the packer 16 will not wind up and a rotational seal, called swivel by those skilled in the art, need not be provided.

Furthermore, it is also possible to provide hydraulic, pneumatic and/or electric connections in the same fashion, e.g. flexible hydraulic hoses 17 for operating the packer 16, which are rigidly connected to the packer 16 on the one end and to a hydraulic pressure source 18 on the other end.

As will be clear, during insertion or retraction of the casing 1, the oscillating movement is performed simultaneously with the axial movement. However, when axial displacement of the casing is not necessary, e.g. while the mud motor 6 and/or the drill 5 is retracted, the oscillating movement can be continued, thereby greatly reducing the chance of the casing 1 getting stuck in the borehole 2. In operation, the casing 1 will act as a torsional spring, thereby assisting the motor 11 in driving the casing to oscillate.

Figure 2:
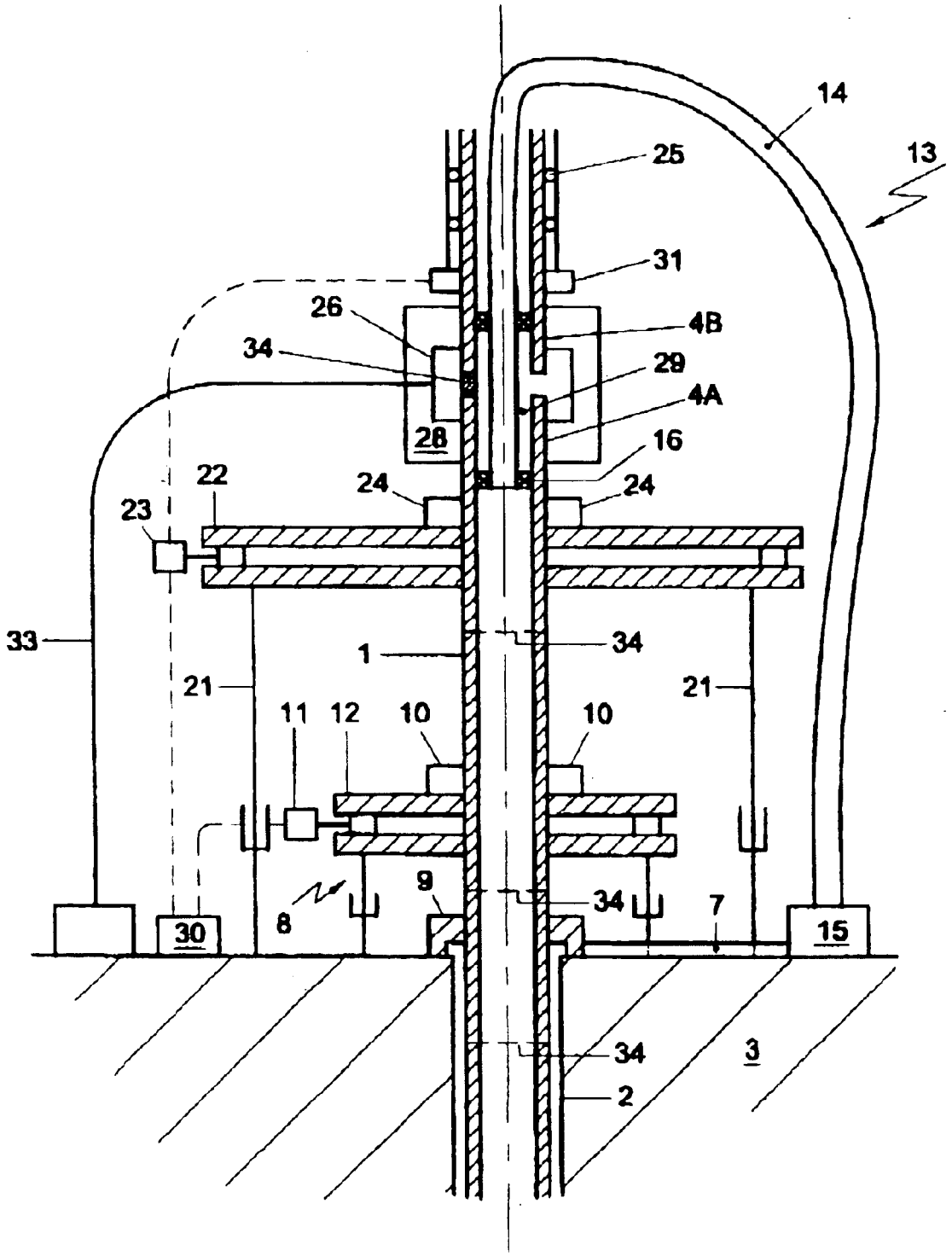
FIG. 2 is a schematical cross-section of a apparatus for composing a casing from casing parts and inserting the composed casing in a borehole, while simultaneously drilling the borehole.

Referring to FIG. 2 it is shown that in a further embodiment of the invention, in order to decrease down-time and in order to enable continuous insertion of a composed casing 1 into the borehole 2, a second drilling table 20 is provided. This drilling table is of similar construction as the drilling table 8 and is also provided with hydraulically adjustable legs 21, a rotationally disposed upper portion 22 driven by a motor 23 and carrying clamps 24.

The second drilling table 20 also carries guiding means 25 in which a casing part 4B can be inserted, such that it is axially aligned with the proximal end of the casing 1 projecting from the borehole and can be synchronised in axial oscillation therewith by drives 31, operatively coupled to control means 30. When the tube parts 4A, 4B are disposed end-to-end they can be welded together by means of a welding apparatus 26 disposed on the upper portion 22 of the second drilling table 20, such that it can rotate substantially jointly with the casing 1. Due to the oscillating movement within the pre-selected angular range, the electrical connections 33 between the surface 7 and the welding apparatus 26 can be configured as cables with plugs on each end, while the need for a commuter is obviated. The welding apparatus 26 is disposed within a neutral-gas environment extending both on the radial outside of the casing 1 and the casing part 4B to be connected therewith and on the radial inside thereof. On the radial outside, the neutral gas environment is provided as a chamber 28, while on the radial inside the neutral gas environment is e.g. provided by means of a seal 34, cooperating with the packer 16 to form a chamber 29, such as to create an explosion proof environment for the welding or cutting process. Instead of neutral gas, the welding chamber and the annular space of the tube part to be connected may be flushed with air from a secure source such as to eliminate explosion hazards.

The welding apparatus is arranged to rotate about the axis A of the casing, such that a circular weld 34 can be provided between the tube parts.

Preferably, the length of the tube parts 4A, 4B, 4C is chosen in relation to the speed of synchronisation and welding, such that at full speed of insertion, a successive tube part 4B can be connected to the casing 1 before axial insertion of a tube segment is completed. It should be noted that, in order to enable constant axial insertion, the drilling tables 8 and 20 are arranged to cooperate in a relay fashion, such that at any time at least one drilling table rotationally drives the casing and simultaneously inserts the casing axially into the borehole 2, while the other drilling table stretches its legs. Both tables 8 and 20 may be combined in one unit which oscillates as one assembly. As the tube parts are driven on the radial outside, the motors 11, 23 can be placed relatively close to the surface 7 and a top-drive can be omitted. This way, the casing parts can be hoisted into the guiding means 25 with a conventional crane and a rig structure need not be built.

Figure 2A:
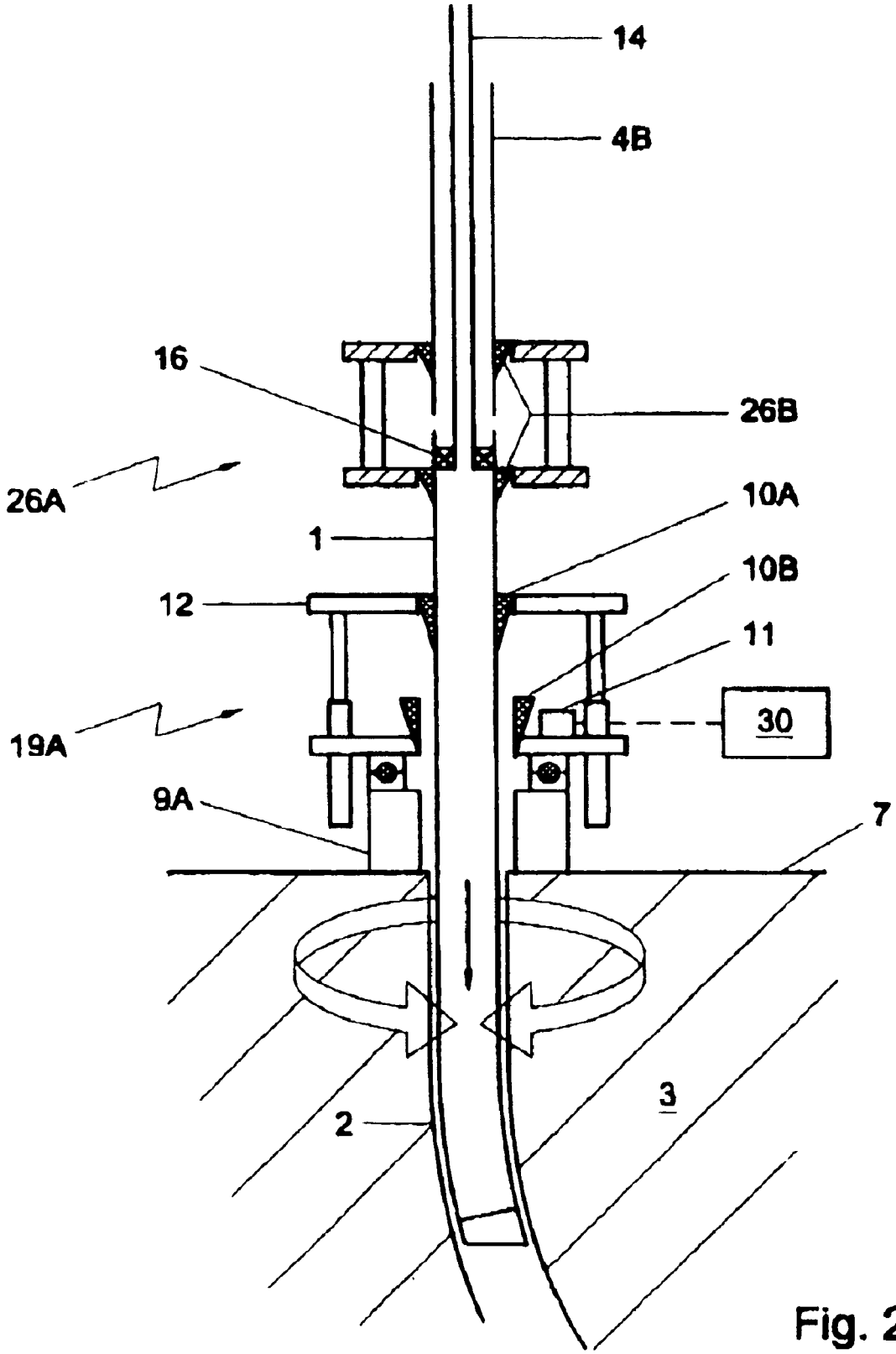
FIG. 2A is a schematical diagram of yet another embodiment of an apparatus for composing a casing from casing parts and inserting the composed casing in a borehole.

In another embodiment of the invention shown in FIG. 2A the welding or cutting process is not combined with an upper table 20 to keep the leg structure compact, e.g. with a stroke of typically less than 3 meters. The welding or cutting process in this embodiment is contained in a welding apparatus 26A that is clamped to the tube 1 by means of clamps 26B and comprises alignment means for aligning tube section 4B. The welding apparatus 26A can be moved axially along the tube 1. The table 8A is rotationally disposed on the blowout preventor 9A and allows axial insertion, while the clamps 10B are provided to retain the tube while the legs 19A are stretched in an upward stroke.

It shall be clear that it is also possible to axially retract the casing 1 from the borehole 2 using the apparatus of FIGS. 2 and 2A. In this case, instead of a welding apparatus 26, 26A an abrasive cutter or any known cutting process can be installed.

It shall be noted that means may be provided on e.g. the welding apparatus to post-weld heat-treat the connection.

It shall be noted that in addition means may be provided, e.g. on the assembly of hose 14 and packer 16, to remove excess material from the inside of the weld zone. Such means may be configured to fully smoothen or polish the inside of the weld zone. Advantageously, such means are configured to smoothen or polish the entire inside of tube section 4B or to cover it with a coating.

It shall be noted that the assembly of hose 14 and packer 16 may include devices to properly internally align the tube end protruding from the hole (4A) and the new tube section 4B. Such alignment device may also be integrated with the welding apparatus.

It shall be noted that the welding apparatus may be provided with any type of tools to remove excess welding material and smoothen or polish the outside of the weld zone. This functionality may also be extended such that the entire outside of tube section 4B can be smoothened or polished or covered with a coating.

It shall be clear that it is possible to configure only selected sub-elements of the system to oscillate. The composition of the system can e.g. be such that for example welding or cutting and the replacement of the drilling tools can take place in an oscillating mode, while during normal drilling continuous right or left hand rotation can be performed, in this case a swivel would e.g. be applied with a rotating seal for the mud supply hose. In general, any combination of oscillating and rotating modes can be selected to improve the drilling performance, optimise the design of the equipment etc. In particular, the method may include oscillating rotating movements while welding and/or steering, and continuous rotating movements while drilling.

The constructional details of the drilling table will not be described in detail, many ways of realising the construction will be apparent to the skilled man. For further detail reference is made to international patent applications WO 99/34089, WO 99/34091 and PCT/NL 98/00597.

It should be noted chat it is also possible to provide the motors 11, 23 with means for accumulating energy, e.g. a fly wheel or springs, in order to assist the motors 11, 23 when the angular rotational movement is reversed.

It shall be clear that the drilling tables can be used advantageously by themselves. In particular, the rotationally disposed table with the grippers 20 and the motor 11 provided with control means 30 to induce alternating, angularly opposite rotating movements can by themselves be used to drive a tube or a casing to oscillate, thus reducing the chance of the tube getting stuck in a borehole.

Figure 3E:
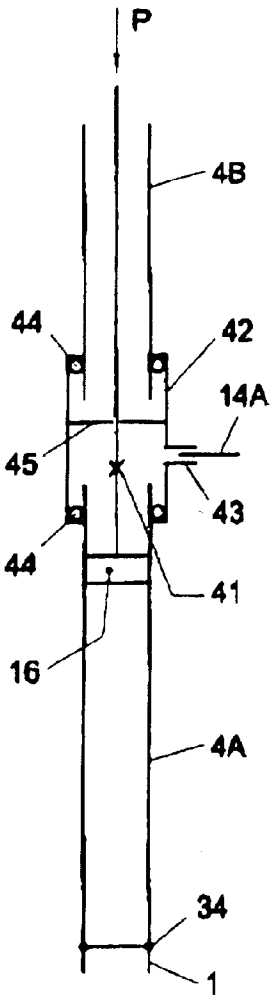
FIGS. 3A–E show a mud chamber for providing continuous mud flow while drilling in various stages of operation.
Figure 3D:
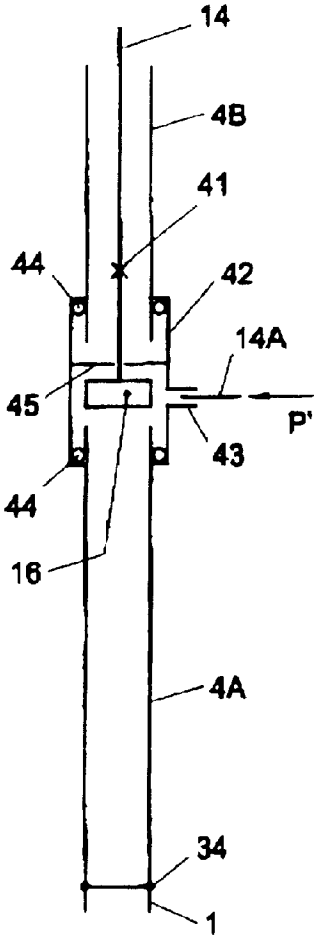
Figure 3C:
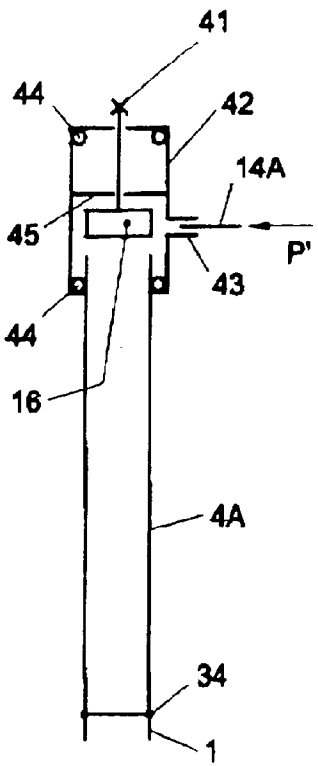
Figure 3B:
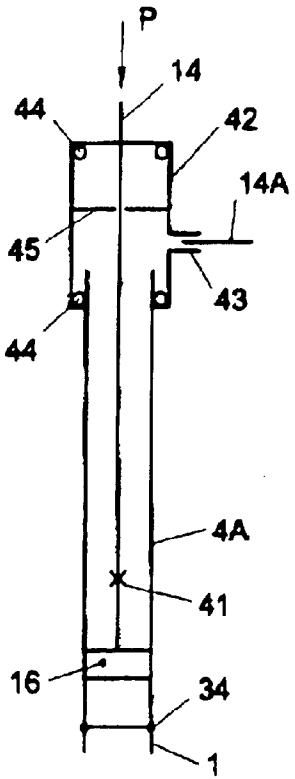
Figure 3A:
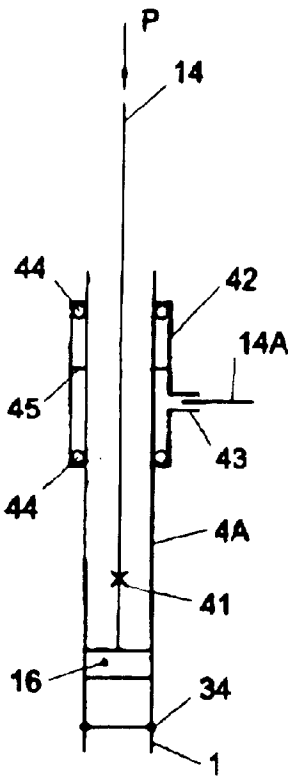

Referring to FIGS. 3A–E it is elucidated how, due to the oscillating movement, the mud supply can be continued while successive casing parts are connected. FIG. 3A shows that the packer 16 is connected to the flexible hose 14 of the mud supply 13 by means of quick connect coupling 41. When a subsequent casing part 4B is to be connected to the uppermost casing part 4A, a mud chamber 42 is placed on the upper portion of the casing pert 4A as shown in FIG. 3B. This mud chamber 42 may or may not be part of the structure housing the welding or cutting process. The mud chamber 42 is provided with a side entry 43 where a secondary flexible hose 14A is fixedly connected to the mud chamber 42, e.g. by means of a clamp connection. As the mud chamber 42 oscillates jointly with the casing, the connection between the mud chamber 42 and the mud pump 15 can be a simple flexible connection. The mud chamber 42 furthermore comprises seals 44 for sealingly connecting it to the casing 1. The mud chamber 42 further comprises an adjustable seal 45, e.g. an hydraulically actuable diaphragm through which the flexible hose 14A can pass sealingly.

As a first step, the mud chamber 42 is axially moved upwards (FIG. 3B) and the mud supply 13 is adjusted to feed mud through the secondary flexible hose 14A, while the supply through the flexible hose 14 is cut (FIG. 3C). This can be performed by a set of suitable valves. The mud flow is indicated with arrows P and P'. Simultaneously, the packer 16 is released, e.g. by hydraulic operation, and is retracted via the flexible hose 14 until it is located in the mud chamber 43 near the adjustable seal 45.

Subsequently, the flexible hose 14 is released from the quick connect coupling 41 and is axially fed through the casing part 4B that is to be connected to the casing part 4A. Next, the quick connect coupling 41 is reconnected and the next casing part 4B in placed (FIG. 3D). The packer 16 in then lowered into the casing part 4A, as is shown in FIG. 3E. When the packer 16 is in place, it is actuated to sealingly engage the inner portion of the casing part 4A, while simultaneously the mud flow is transferred from the secondary flexible hose 14A back to the flexible hose 14. The mud chamber 42 can now be moved axially upward onto the casing section 4B, leaving the abutting edges of the casing parts 4A and 4B free to be welded. After the weld has been realised, the packer 16 can be moved axially upwards, thereby completing the operating cycle 4B.

Alternative methods of inserting casing section 4B includes the pre-installation of hose 14 and packer 16 in the casing 14 to be connected. The mud chamber 42 would then be constructed in such a way that hose 14 and packer 16 can be completely removed from the tube end 4A, and that section 4B including the pre-installed hose 14 and packer 16 assembly can be installed.

The constructional details of the mud chamber 42, the seals 44, 45, the packer 16, the quick connect coupling 41 and the valves needed to direct the mud flow through the flexible hoses are known to the skilled man. In particular a number of advantageous constructive details of the mud chamber are discussed in PCT/NL/98/00597. It should be noted that the method of providing a continuous mud circulation with the disclosed mud chamber can in itself have many advantageous uses. In particular, the fixed, non-rotating connections between the flexible hoses 14, 14A enable simple and reliable operation.

In a further embodiment of the invention during displacement of the tube, a technique is applied which is known as reverse circulation in the field. This technique is particularly suitable for the installation of large diameter casing, typically larger than 13⅜" OD casing and for conditions with weak ground formations in an openhole section. With reverse circulation mud is added to the annular space between the casing that is installed and a previous, usually cemented casing. However the mud may also be added between the casing that is being installed and an inner tube. The return stream of the mud and the formation fragments liberated by the drilling process will then flow via the casing being intstalled itself or an inner tube which is connected to the drilling process module. The power to drive the drilling process module can be electrically, hydraulically or pneumatically configured. The differential pressure between the mudflow into the annular space and the return flow to surface can be provided by the injection of air or non combustible gas in the return stream, utilising a technique called airlift by those skilled in the art, or by any other means of maintaining a sufficient pressure differential.

Figure 4:
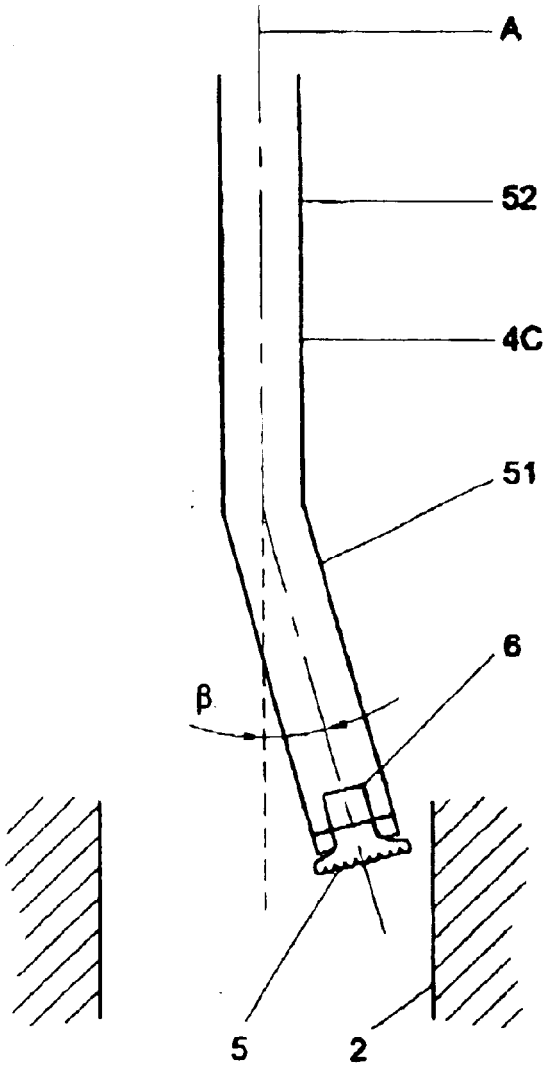
FIG. 4 shows a lower most casing part with a bent tip or for directional drilling.
Figure 5:
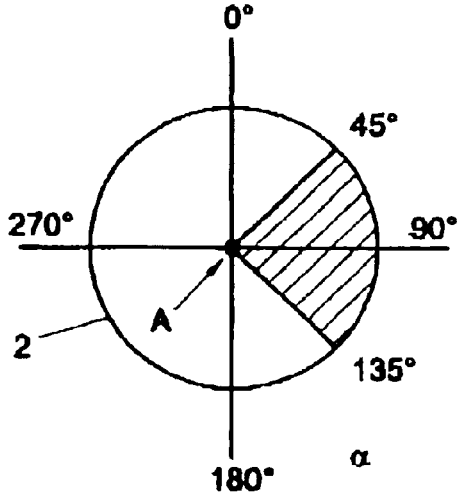
FIG. 5 shows a circular segment corresponding to an pre-selected angular range of rotation for directional drilling.

Referring to FIGS. 4 and 5 it is shown how the casing 1 can be used for directional drilling. To this end, the bottom most casing part 4C is provided with a tip portion 51 extending at an angle β relative to the portion 52. For sake of clarity, the angle β has been drawn on an enlarged scale. However, in practice, the angle β can be chosen at a small value, e.g. 5° or less, preferably 1–3°. Alternatively the bottom most casing part may be provided with, for example, devices eccentrically stand-off from the axis A to force the casing from a straight line path. When the bottom most casing part 4C or "sub" is rotated about the longitudinal axis A over a full circular segment, i.e. the angular range of rotation is at least 360°, the casing 1 will advance in a straight line when it is advanced axially into the ground 3. However, when the bottom most casing part 4C is oscillated with alternating, angularly opposite rotating movements within a circular segment, i.e. less than 360° e.g. a range of angular rotation including 90° extending from 45° to 135°, ground is removed in only a part of the circumference at the bottom of the lower-most segment and the casing 1 will follow a curved path when it is advanced into the ground 3. Especially when a casing 1 is used with a high torsional resistance, e.g. a casing with a large diameter or a casing having a composite structure, e.g. fiber reinforced plastic, the torsional lag between the upper portion of the casing projecting from the surface 7 of the ground 3 and the bottom most portion of the casing carrying the drill 5 will be relatively small, such that a high accuracy can be achieved in directional drilling.

It shall be clear that the bottom most casing part 4C having a tip portion extending at an angle β can also be used for directional drilling of a tube that comprises only one segment or a tube of which the tube parts are connected prior to drilling. It can even be envisaged to perform oscillations within a circular segment with such a casing part during conventional, rotating drilling to change direction.

It shall be clear to the skilled man that the invention is not limited to the preferred embodiments discussed herein and that many aspects of the invention can either be used independently of each other or combined. In particular, the method can be used offshore for seabed drilling. Also, the method can be used during underbalanced conditions. Furthermore, the method can be used for inserting a tube in a predrilled borehole and/or a normal drilling rig may be used. Such embodiments are within the scope of the invention as defined in the appended claims.

What is claimed is:

1. A method for axially moving a tube in a borehole in the ground, wherein the tube is moved simultaneously along and about its axis and wherein a drill is used of which the rate of material removal is independent of the direction or speed of rotation of the tube about its axis, and wherein a drive mechanism for the drill is connected to the tube and is rotated jointly with the tube wherein the tube is moved about its axis in a series of alternating, angularly opposite, rotating movements within a limited angular range of rotation, the angular range comprising at least one full rotation of 360°.

2. A method according to claim 1, wherein the limited angular range of rotation is preselected to comprise less than 1800°.

3. A method according to claim 2, wherein the limited angular range of rotation is preselected to comprise less than 1080°.

4. A method according to claim 3, wherein the limited angular range of rotation is preselected to comprise less than 720°.

5. A method according to claim 1, wherein the time needed to complete two consecutive, alternating angularly opposite rotating movements is at least 10 s.

6. A method according to claim 5, wherein the time needed to complete two consecutive, alternating angularly opposite rotating movements is at least 20 s.

7. A method according to claim 1, wherein the frequency of alternating angularly opposite rotating movements is such that an oscillation is generated that corresponds to the base or higher order natural frequency of the tube.

8. A method according to claim 1, wherein a series of alternating, angularly opposite, rotating movements within the pre-selected angular range of rotation is preceded and/or succeeded by a non-oscillating, continuous rotating movement about its axis.

9. A method according to claim 1, wherein said tube is composed by connecting successive tube parts rotationally rigid end-to-end.

10. A method according to claim 9, wherein tube parts are connected end-to-end by welding.

11. A method according to claim 9, wherein said tube parts are connected while axially inserting the tube into the borehole.

12. A method according to claim 1, wherein the tube is axially moved into the borehole in the ground to form a casing for a borehole.

13. A method according to claim 12, wherein the tube is inserted while a borehole is being drilled by a drill.

14. A method according to claim 1, wherein the moving of the tube in said series of alternating, angularly opposite, rotating movements is followed by a second series of such movements within a second preselected angular range, which second preselected angular range of rotation includes less than 360°, to remove ground in a circular segment at the tube end, such that, when the tube is axially advanced into the borehole, a tip of the tube is advanced along a curved path.

15. A method according to claim 14, wherein the second preselected angular range of rotation includes less than 180°.

16. A method according to claim 1, wherein the torque exerted on the tube at the surface is measured while performing angularly symmetrical opposite, rotating movements within the preselected angular range to determine a mid-point of lower torque values.

17. A method according to claim 1, wherein relative angular orientation of tube sections axially spaced apart is monitored.

18. A method according to claim 17, wherein said monitoring includes observing an axial line provided on the outside of the tube.

19. A method according to claim 17, wherein said monitoring includes detecting angular orientations of axially spaced magnetic markings on the outside of the tube.

20. A method according to claim 19, wherein said series of alternating, angularly opposite, rotating movements have an azimuth at the tube tip, said azimuth at the tube tip being controlled in response to the orientation of the tube in the area of the ground surface.

21. A method according to claim 20, wherein an alternating torque having an azimuth is exerted to said tube, said azimuth at the tube tip being further controlled in response to the orientation of the tube in the area of the ground surface when said azimuth of said torque occurs.

22. A method according to claim 1, wherein pumping of mud is continued while a connection with a next tube section is being made via a hose and packer combination which sealingly connects to the tube section in the hole.

23. A method according to claim 1, wherein the moving of the tube in said series of alternating, angularly opposite, rotating movements is preceded by a second series of such movements within a second preselected angular range, which second preselected angular range of rotation includes less than 360°, to remove ground in a circular segment at the tube end, such that, when the tube is axially advanced into the borehole, a tip of the tube is advanced along a curved path.

24. A method according to claim 23 wherein the second preselected angular range of rotation includes less than 180°.

25. A device for axially moving a tube in a borehole in the ground, comprising means for moving the tube along and about its axis and connections for connecting the tube to a drive mechanism for a drill carried on a bottom most part of the tube and rotating jointly with the tube, wherein the means for moving the tube about its axis comprises a rotational drive that is arranged to drive the tube to rotate about its axis in at least one full rotation and that is operatively coupled to control means for controlling the drive to perform alternating, angularly opposite, rotating movements within a limited angular range of rotation, the angular range comprising at least one full rotation of 360°.

26. A device according to claim 25, wherein the limited angular range of rotation is preselected to comprise less than 1800°.

27. A method according to claim 26, wherein the limited angular range of rotation is preselected to comprise less than 1080°.

28. A method according to claim 27, wherein the limited angular range of rotation is preselected to comprise less than 720°.

29. A device according to claim 25, wherein the rotational drive and the control means are further configured to selectively control the drive to perform a continuous, non-alternating, rotating movement.

30. A device according to claim 25, wherein it comprises a welding apparatus for welding tube segments end-to-end to form a composed tube, which welding apparatus is arranged to rotate substantially jointly with the tube to be moved in the borehole.

31. A device according to claim 30, wherein it is provided with means for surface treatment of the inner and/or outer surface of the tube to be inserted.

32. A device according to claim 30, wherein it is provided with means for aligning and positioning tube ends to be connected.

33. A device according to claim 25 in combination with a packer for sealing the tube and arranged to rotate substantially jointly therewith, comprising connecting means for connecting to a fluid or energy supply, wherein said connecting means are arranged to fixedly couple the packer to a flexible fluid or energy supply extending from the fluid source.

34. A device according to claim 25, wherein the control means is further arranged to control the drive to perform a second series of alternating, angularly opposite, rotating movements within a second preselected angular range, which second preselected angular range of rotation includes less than 360°.

35. A device according to claim 34, wherein the second preselected angular range of rotation includes less than 180°.

36. A method for axially moving a tube in a borehole in the ground, wherein the tube is moved simultaneously along and about its axis, wherein the ground is removed at the tube end, and wherein moving the tube about its axis (A) comprises moving the tube in a first series of alternating, angularly opposite, rotating movements within a first preselected angular range of rotation, the first preselected angular range being a limited range of rotation, wherein the first preselected angular range comprises at least one full rotation of 360°.

37. A method according to claim 36, wherein the first angular range of rotation is preselected to comprise less than 1800°.

38. A method according to claim 37, wherein the limited angular range of rotation is preselected to comprise less than 1080°.

39. A method according to claim 38, wherein the limited angular range of rotation is preselected to comprise less than 720°.

40. A method according to claim 36, wherein the time needed to complete two consecutive, alternating angularly opposite rotating movements is at least 10 s.

41. A method according to claim 40, wherein the time needed to complete two consecutive, alternating angularly opposite rotating movements is at least 20 s.

42. A method according to claim 36, wherein the frequency of alternating angularly opposite rotating movements is such that an oscillation is generated that corresponds to the base or higher order natural frequency of the tube.

43. A method according to claim 36, wherein a series of alternating, angularly opposite, rotating movements within the preselected angular range of rotation is preceded and/or succeeded by a non-oscillating, continuous rotating movement about its axis.

44. A method according to claim 36, wherein said tube is composed by connecting successive tube parts rotationally rigid end-to-end.

45. A method according to claim 44, wherein tube parts are connected end-to-end by welding.

46. A method according to claim 44, wherein said tube parts are connected while axially inserting the tube into the borehole.

47. A method according to 36, wherein the tube is axially moved into the borehole in the ground to form a casing for a borehole.

48. A method according to claim 47, wherein the tube is inserted while a borehole is being drilled by a drill.

49. A method according to 36, wherein the torque exerted on the tube at the surface is measured while performing angularly symmetrical opposite, rotating movements within the preselected angular range to determine a mid-point of lower torque values.

50. A method according to claim 36, wherein relative angular orientation of tube sections axially spaced apart is monitored.

51. A method according to claim 50, wherein said monitoring includes observing an axial line provided on the outside of the tube.

52. A method according to claim 50, wherein said monitoring includes detecting angular orientations of axially spaced magnetic markings on the outside of the tube.

53. A method according to claim 36, wherein pumping of mud is continued while a connection with a next tube section is being made via a hose and packer combination which sealingly connects to the tube section in the hole.

54. A method according to claim 36, wherein the first series of alternating, angularly opposite, rotating movements is followed by a second series of such movements within a second preselected angular range, which second preselected angular range of rotation includes less than 360°, to remove ground in a circular segment at the tube end, such that, when the tube is axially advanced into the borehole, the tip of the tube is advanced along a curved path.

55. A method according to claim 54, wherein the second preselected angular range of rotation includes less than 180°.

56. A method according to claim 36, wherein the first series of alternating, angularly opposite, rotating movements is preceded by a second series of such movements within a second preselected angular range, which second preselected angular range of rotation includes less than 360°, to remove ground in a circular segment at the tube end, such that, when the tube is axially advanced into the borehole, the tip of the tube is advanced along a curved path.

57. A method according to claim 56, wherein the second preselected angular range of rotation includes less than 180°.

58. A device for axially moving a tube in a borehole in the ground, comprising means for moving the tube along and about its axis, whereby the means for moving the tube about its axis comprises a rotational drive that is operatively coupled to control means for controlling the drive to perform alternating, angularly opposite, rotating movements within a first preselected angular range of rotation, the first preselected angular range being a limited range of rotation, wherein the first preselected angular range comprises at least one full rotation of 360°.

59. A device according to claim 58, wherein the first angular range of rotation comprises less than 1800°.

60. A method according to claim 59, wherein the limited angular range of rotation is preselected to comprise less than 1080°.

61. A method according to claim 60, wherein the limited angular range of rotation is preselected to comprise less than 720°.

62. A device according to claim 58, wherein the rotational drive and the control means are further configured to selectively control the drive to perform a continuous, non-alternating, rotating movement.

63. A device according to claim 58, which device comprises a welding apparatus for welding tube segments end-to-end to form a composed tube, which welding apparatus is arranged to rotate substantially jointly with the tube to be moved in the borehole.

64. A device according to claim 63, which device is provided with means for surface treatment of the inner and/or outer surface of the tube to be inserted.

65. A device according to claim 63, which device is provided with means for aligning and positioning tube ends to be connected.

66. A device according to claim 58, wherein the control means is further arranged to control the drive to perform a second series of alternating, angularly opposite, rotating movements within a second preselected angular range, following the first series of such movements, which second preselected angular range of rotation includes less than 360°.

67. A device according to claim 66, wherein the second preselected angular range of rotation includes less than 180°.

68. A device according to claim 58, wherein the control means is further arranged to control the drive to perform a second series of alternating, angularly opposite, rotating movements within a second preselected angular range, preceding the first series of such movements, which second preselected angular range of rotation includes less than 360°.

69. A device according to claim 68, wherein the second preselected angular range of rotation includes less than 180°.

70. A device according to claim 58 in combination with a packer for sealing a tube comprising connecting means being arranged to fixedly couple the packer to a flexible fluid or energy supply, wherein the packer and the flexible fluid or energy supply are arranged to rotate substantially jointly with the tube.

71. The combination of claim 70, wherein the flexible fluid or energy supply extends from a fluid source or energy source.

* * * * *

UNITED STATES PATENT AND TRADEMARK OFFICE

CERTIFICATE OF CORRECTION

PATENT NO. : 6,796,390 B2
DATED : September 28, 2004
INVENTOR(S) : Thomas W. Bakker It is certified that error appears in the above-identified patent and that said Letters Patent is hereby corrected as shown below:

Column 1,
Line 30, delete “tune”, insert -- tube --
Line 32, after “borehloe,”, insert -- e.g. --
Line 38, after “reversed.”, insert -- During insertion or retraction the composed tube is driven to rotate about its axis in a fixed direction, such that continuous rotation is achieved. This is done to provide --

Signed and Sealed this

Twenty-first Day of June, 2005

JON W. DUDAS
*Director of the United States Patent and Trademark Office*